US006130701A

United States Patent [19]

Ito

[11] Patent Number: 6,130,701

[45] Date of Patent: Oct. 10, 2000

[54] SCANNER APPARATUS AND IMAGE RECORDING APPARATUS PROVIDED WITH ARRAY-LIKE LIGHT SOURCE

[75] Inventor: Masao Ito, Nakai-machi, Japan

[73] Assignee: Fuji Xerox Co., Ltd., Tokyo, Japan

[21] Appl. No.: 08/911,072

[22] Filed: Aug. 14, 1997

[30] Foreign Application Priority Data

Aug. 22, 1996 [JP] Japan ..... 8-220905

[51] Int. Cl.[7] ..... B41J 2/435

[52] U.S. Cl. ..... 347/241; 347/244

[58] Field of Search ..... 347/241, 244, 347/256, 258; 358/298; 359/565, 211; 351/206

[56] References Cited

U.S. PATENT DOCUMENTS

| | | | |
|---|---|---|---|
| 4,268,871 | 5/1981 | Kawamura | 358/298 |
| 4,445,125 | 4/1984 | Seifres et al. | 346/108 |
| 5,227,910 | 7/1993 | Khattak | 359/211 |
| 5,382,987 | 1/1995 | Sperling | 351/206 |
| 5,471,236 | 11/1995 | Ito | 347/233 |
| 5,547,849 | 8/1996 | Baer et al. | 435/7.24 |
| 5,691,847 | 11/1997 | Chen | 359/565 |

FOREIGN PATENT DOCUMENTS

| | | |
|---|---|---|
| 64-42667 | 2/1989 | Japan . |
| 1-152683 | 6/1989 | Japan . |

OTHER PUBLICATIONS

J. Opt. SOC. Am. A, vol. 4, No. 4, Apr. 1987, p. 651–654.

Optics Communications, vol. 64, No. 6/15 Dec. 1987, p. 491–495.

"Focusing of Spherical Gaussian Beams", Applied Optics, Sidney a. Self, vol. 22, No. 5, Mar. 1983.

*Primary Examiner*—N. Le
*Assistant Examiner*—Anh T. N. Vo
*Attorney, Agent, or Firm*—Oliff & Berridge, PLC

[57] ABSTRACT

A scanner apparatus and an image recording apparatus are provided with an array-like light source. A plurality of laser beams emitted from a semiconductor laser array are collected into a limited space region by a field lens, and an optical element integral with an image forming lens and a Fourier conversion element is arranged in the space region to form the plurality of laser beams into beams having a light intensity distribution of a Bessel-Gaussian type on a photosensitive drum.

21 Claims, 9 Drawing Sheets

SCANNER APPARATUS AND IMAGE RECORDING APPARATUS PROVIDED WITH ARRAY-LIKE LIGHT SOURCE

BACKGROUND OF THE INVENTION

1. Field of the Invention

The present invention relates to a scanner apparatus and an image recording apparatus provided with an array-like light source, and particularly to an image recording apparatus provided with an array-like light source having high scanning accuracy and an image recording apparatus provided with an array-like light source which suppresses a variation of a beam diameter caused by deviation of focal position without using an autofocus mechanism to realize image recording of high quality and high density at high speeds.

2. Description of the Related Art

For making the recording speed of an image recording device higher, there has been studied an image recording apparatus for driving an array-like light source according to a recorded image pattern, without using a polygon mirror, which has a limitation in making its rotational speed higher, to thereby exit a plurality of light beams.

A conventional image recording apparatus provided with an array-like light source as described is disclosed, for example, in Japanese Published Unexamined Application No. Sho 64-42667. This image recording apparatus has the constitution in which a surface emission laser array is arranged in the vicinity of a photosensitive drum to directly expose the photosensitive drum. It is contemplated that according to this image recording apparatus, the surface emission laser array is driven at high speeds, and the photosensitive drum is driven at rotational speeds according to the driving speed of the surface emission laser array to obtain high speed image recording.

Further, a conventional laser array scanner provided with an array-like light source is disclosed, for example, in Japanese Published Unexamined Patent Application No. Hei 1-152683. This laser array scanner comprises a semiconductor laser array having a plurality of semiconductor lasers disposed in a row, and optical means, a convex lens having a larger diameter than the length of the semiconductor laser array so as to include all the light emitting portions of a plurality of semiconductor lasers. It is contemplated that according to this laser array scanner, when the semiconductor laser arrays are driven at high speeds, the high-speed scanning can be realized.

However, according to the conventional image recording apparatus and laser array scanner provided with an array-like light source, deviation in a focal position occurs depending on change in temperature, accuracy of mounting, accuracy of parts, vibrations, etc. so that abeam diameter varies. Accordingly, the image recording of high density, 1200 dpi, demanded recently, cannot be carried out with high quality and at high speeds.

On the other hand, it is reported in J. Opt. SOC. Am. A, Vol. 4, No. 4/April 1987, P651 to P654, and Optics Communications, Vol. 64, No. 6/Dec. 15, 1987, P491 to P495 that the laser beam having a light-intensity distribution of the 0 order Bessel-Gaussian type is larger in its focal depth than that of a Gaussian type.

As a method for forming a laser beam of the 0 order Bessel-Gaussian type, the former reference discloses a method in which an annular slit is placed in a collimated laser beam, and a light beam coming out thereof is subjected to Fourier conversion to thereby increase resolution of the laser beam.

However, according to the conventional image recording apparatus and laser array scanner provided with an array-like light source, since a plurality of laser beams are emitted to a space region corresponding to the length in a main scanning direction of the semiconductor laser arrays, it is difficult to practically ensure that (1) the respective laser beams are collimated and (2) Fourier conversion elements are arranged in the collimated laser beams to equally increase the focal depth of the laser beams. Further, according to the conventional laser array scanner provided with an array-like light source, since the light beams coming from the end of the semiconductor laser arrays are incident with a large incident angle with respect to an optical axis of the convex lens, the quantity of light of the light beams is reduced, and the beam diameter varies.

Therefore, it is necessary that an image forming optical system be arranged between the semiconductor laser array and the scanning surface, and the deviation in a focal position is corrected by an autofocus mechanism. However, since this autofocus mechanism cannot detect the beam diameter at the scanning surface, the light beams are to be branched and detected, giving rise to some problems such that the accuracy is not high, or the like.

SUMMARY OF THE INVENTION

It is therefore an object of the present invention to provide a scanner apparatus and an image recording apparatus provided with an array-like light source in which deviation in a focal position is prevented even when there is a change in temperature, unevenness of accuracy of mounting, unevenness of accuracy of parts, vibrations and the like.

It is another object of the present invention to provide a scanner apparatus and an image recording apparatus provided with an array-like light source which can suppress deviation in a focal position without providing an autofocus mechanism.

It is a further object of the present invention to provide a scanner apparatus and an image recording apparatus provided with an array-like light source in which an incident angle of a light beam with respect to an optical axis of a focusing lens suppresses variation in quantity of light and beam diameter.

For achieving the aforementioned objects, the present invention provides a scanner apparatus provided with an array-like light source for emitting a plurality of light beams, comprising:

collecting means for collecting the light beams emitted from the array-like light source within a limited space region from which the light beams are then focused on a scanning surface;

image-forming means for collimating the light beams, the image-forming means located within the limited space region; and spatial filtering means for imparting modulation to a spatial spectrum of the light collimated beams positioned within the space region.

For achieving the aforementioned objects, the present invention also provides an image recording apparatus provided with an array-like light source for emitting a plurality of light beams modulated according to an image signal, comprising:

collecting means for collecting the light beams emitted from the array-like light source within a limited space region and thereafter focusing them on a photosensitive body;

image-forming means positioned within said limited space region to collimate the light beams and thereafter focus them on the photosensitive body; and spatial filtering means for imparting modulation to a spatial spectrum of the collimated light beams, the spatial filtering means located within the limited space region.

According to the description appearing in Applied Optics/Vol. 22, No. 51/Mar. 1, 1983, p 658 to p 661, when the scanning surface is irradiated with a light beam having a light intensity distribution of a Gaussian type, the radius W (Z) of the light spot on the scanning surface is obtained by the following formula (1):

$$W(Z)=Wo[1+(Z/Zr)^2]^{1/2} \quad (1)$$

wherein W (Z) is the radius of $1/e^2$ strength, Wo is the radius of $1/e^2$ strength in beam waist, and Z is the distance in an advancing direction of a light beam with the beam waist being an original point. Zr is obtained by the following formula (2).

$$Zr=\pi Wo^2/\lambda \quad (2)$$

wherein $\lambda$ is the wavelength of the light beam.

From the formulae (1) and (2), in the light beam having a light intensity distribution of Gaussian type, a spread angle of beam before and after the beam waist rapidly increases as the beam diameter reduces, and the focal depth is small.

On the other hand, in the light beam having a light intensity distribution of the 0 order Bessel-Gaussian type, the focal depth is large, as explained in the aforementioned two references.

In the present invention, all the light beams modulated and emitted according to an image signal from the array-like light source are collimated beams to provide a limited space region, where beam conversion means is arranged to convert the plurality of light beams to beams having a light intensity distribution of Bessel-Gaussian type. Thereby, there is provided a scanner apparatus and an image recording apparatus provided with an array-like light source simultaneously capable of increasing the focal depth of the plural light beams and suppressing the deviation in a focal position without using an autofocus mechanism.

DESCRIPTION OF THE PREFERRED EMBODIMENTS

Figure 1A:
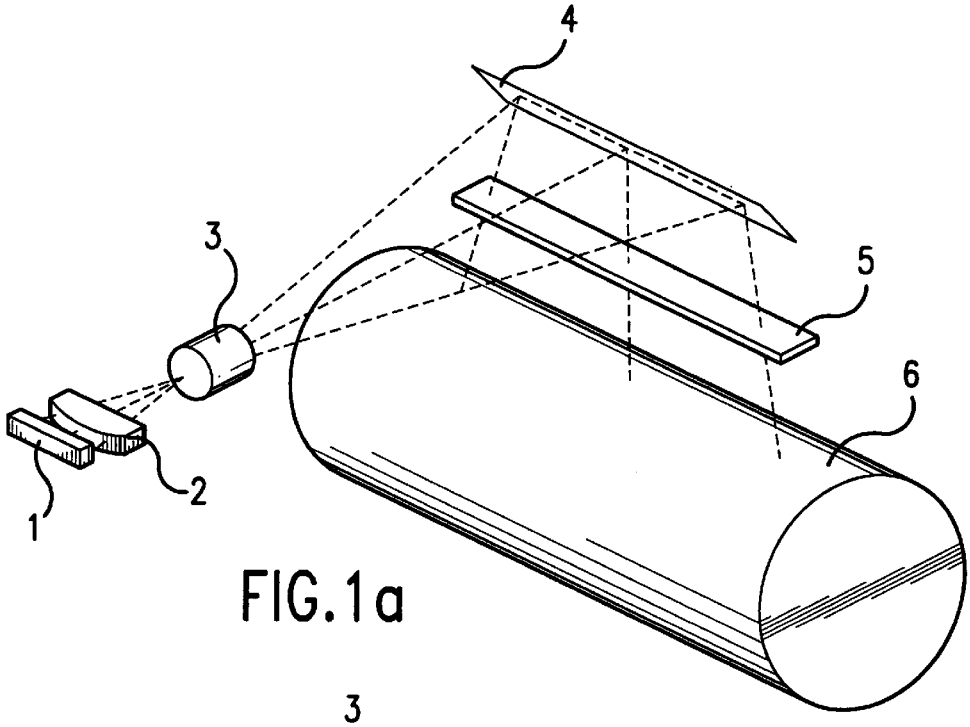
FIGS. 1*a–c* are explanatory views showing a first embodiment of an image recording apparatus provided with an array-like light source.
Figure 1B:
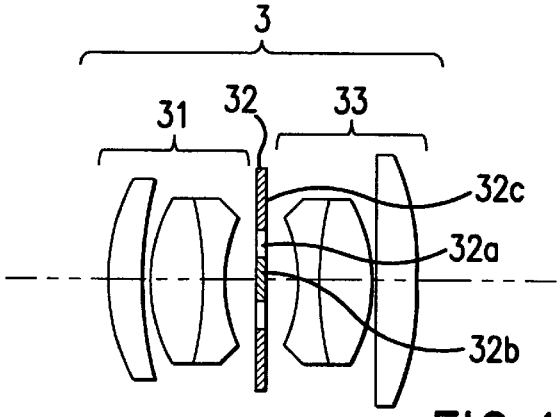
Figure 1C:
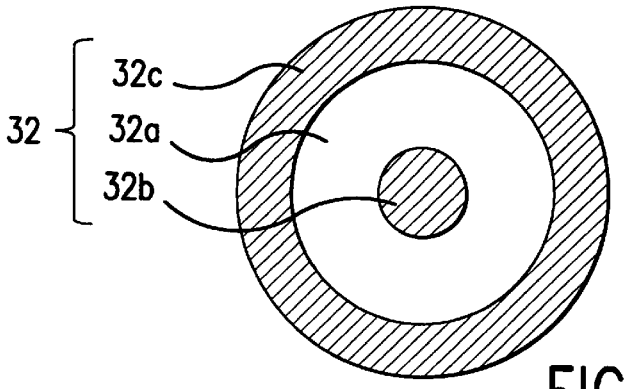

FIG. 1(*a*) shows a first embodiment of an image recording apparatus provided with an array-like light source according to the present invention. This image recording apparatus provided with an array-like light source comprises a semiconductor laser array 1 for emitting a plurality of laser beams modulated according to an image signal in a predetermined timing and pattern, a field lens 2 for collecting the plural laser beams emitted from the semiconductor array 1 on a predetermined scanning surface, an optical system 3 for forming the laser beams collected by the field lens 2 into plural collimated beams within a limited space region and forming a light intensity distribution of the plural collimated beams into a Bessel-Gaussian type on a predetermined scanning surface, a reflecting mirror 4 for reflecting the plural laser beams having been transmitted through the optical system 3 on a predetermined scanning surface, a window glass 5 for transmitting the laser beams reflected by the reflecting mirror 4, and a photosensitive drum 6 exposed by the laser beams having been transmitted through the window glass 5.

FIG. 1(*c*) shows a zonal aperture 32 having a light transmitting portion 32*a* and shield portions 32*b* and 32*c*.

FIG. 1(*b*) shows the optical system 3 shown in FIG. 1(*a*), which comprises a Double Gauss type image forming lens (having a front group lens 31 and a rear group lens 33), and the aperture 32 having the light transmitting portion 32*a* and the shield portions 32*b* and 32*c*. The front group lens 31 is provided to change a curvature wave face for emitting a plurality of laser beams exited from the semiconductor laser array to a flat wave face to have the laser beams incident as collimated beams on the aperture 32. The zonal aperture 32 is provided to convert the laser beams changed to the collimated beams so that the beam intensity distribution is a Bessel-Gaussian type. The rear group lens 33 is designed to form a plurality of laser beams formed into the Bessel-Gaussian type on the photosensitive body 10 as a spot having a predetermined diameter.

Figure 2A:
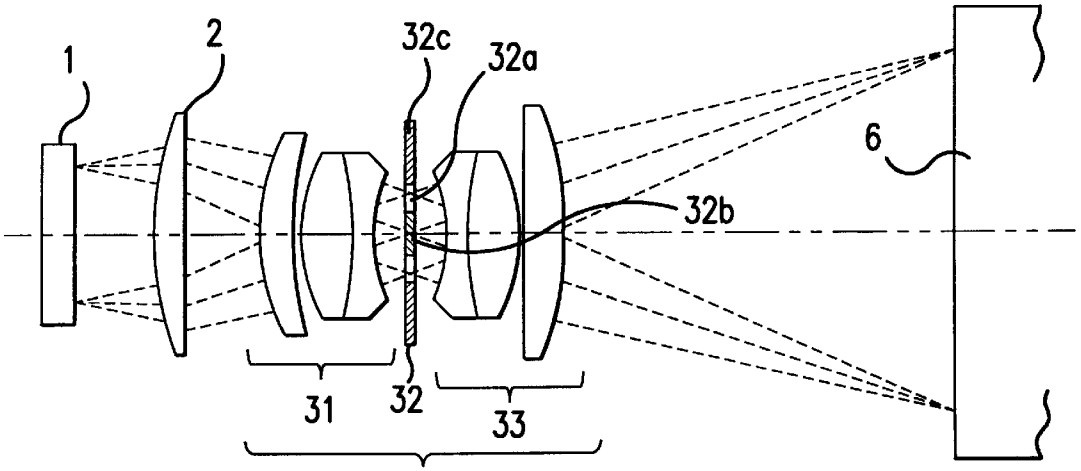
FIGS. 2*a–b* are explanatory views showing the propagation of a laser beam in the first embodiment.
Figure 2B:
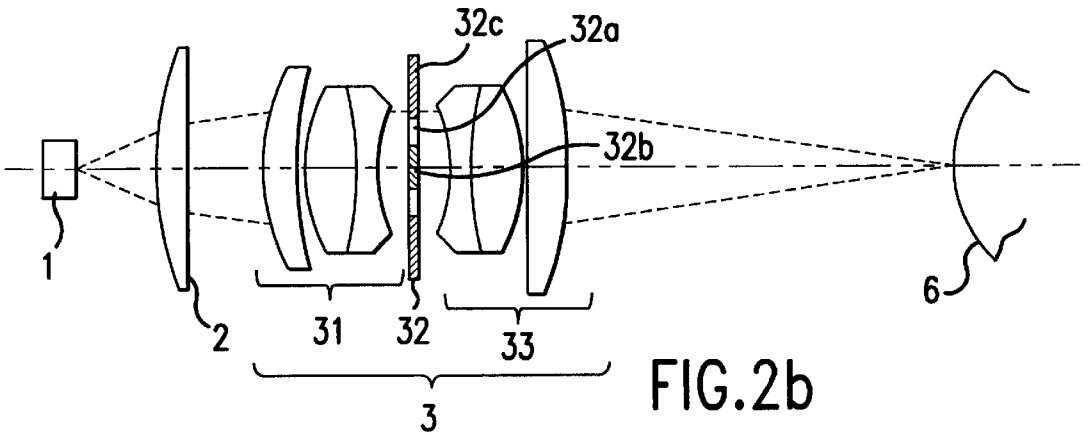

FIGS. 2(*a*) and 2(*b*) show the collecting and image-forming state of laser beams in the first embodiment of the image recording apparatus provided with an array-like light source. The same parts are indicated by the same reference numerals, and redundant explanation is omitted. FIG. 2(*a*) shows the state of the laser beam having the spread in a scanning direction, and FIG. 2(*b*) shows the state of the laser beam having the spread in a sub-scanning direction. As will be apparent from these figures, a plurality of laser beams emitted from the semiconductor laser array 1 are formed into collimated beams between the front group lens 31 and the rear group lens 33.

Figure 3:
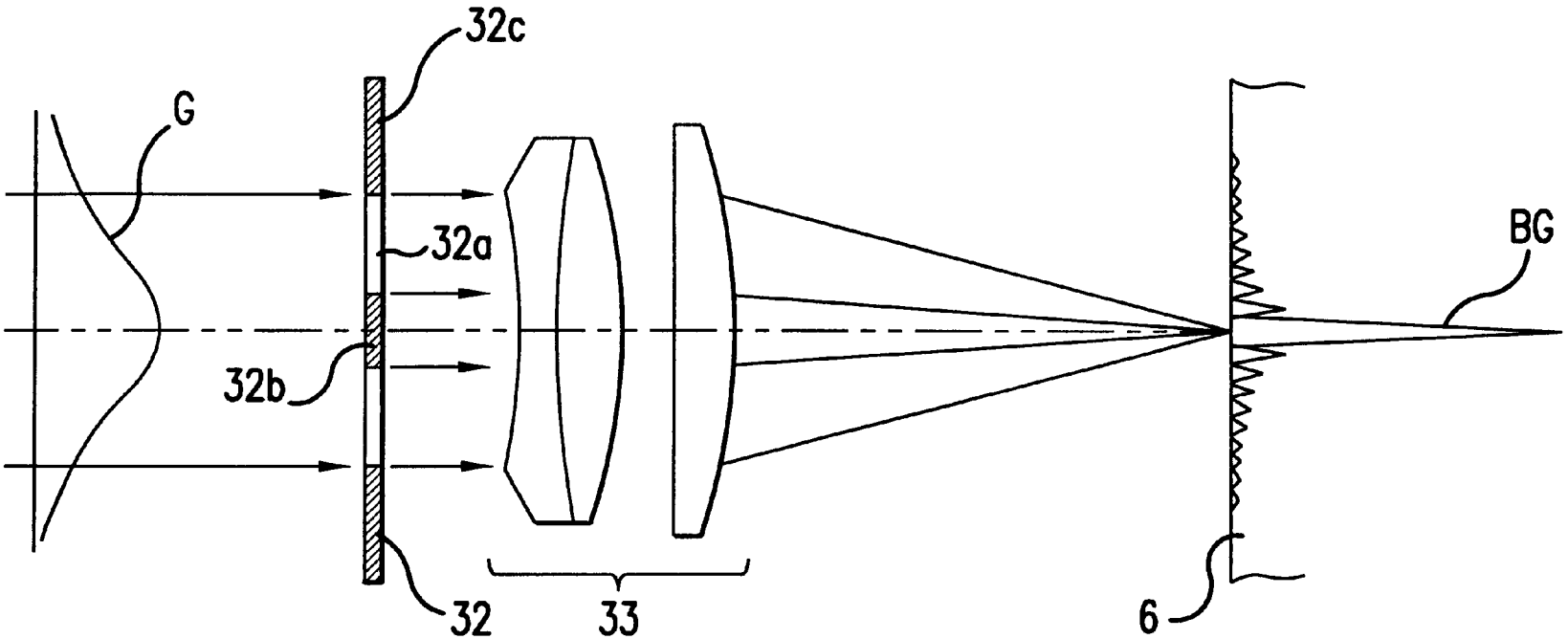
FIG. 3 is an explanatory views showing the conversion of a light intensity distribution of laser beam in the first embodiment.

FIG. 3 shows the zonal aperture 32, the rear group lens 33 and the photosensitive drum 6. The center of the zonal aperture 32 coincides with the optical axis of the image forming lens (the front group lens 31 and the rear group lens 33) and is arranged in a pupil position of the image forming lenses 31 and 33. The laser beams collimated by the front group lens 31 are converted from the light intensity distribution of the Gaussian type as shown by the symbol G in front of the aperture 32 to the light intensity distribution of the Bessel-Gaussian type as shown by a symbol BG on the photosensitive drum 6 by the zonal aperture 32.

As will be apparent from the aforementioned explanation, according to the first embodiment of the image recording apparatus provided with an array-like light source of the present invention, a beam conversion element 32 is provided in which a plurality of light beams emitted from the semiconductor laser array 1 are collimated in a pupil position of the image-forming lenses 31 and 32, and a plurality of collimated beams are converted to a plurality of laser beams having the light intensity distribution of the 0 order Bessuel-Gaussian type to the pupil position. Therefore, it is possible to increase the focal depth of the laser beams on the scanning surface of the photosensitive drum 6. As a result, it is possible to suppress variation of a beam diameter even if the positions of beams waists of a plurality of laser beams are varied due to variation in temperature of an optical system, an error of assembly of an optical system, a lowering of accuracy of optical parts, vibrations, etc. Thereby, it is possible to provide image recording of high accuracy and high quality with reliability. Accordingly, additional mechanisms such as an autofocus mechanism or the like are not necessary, and it is possible to suppress an increase in costs of an image recording apparatus.

Figure 4A:
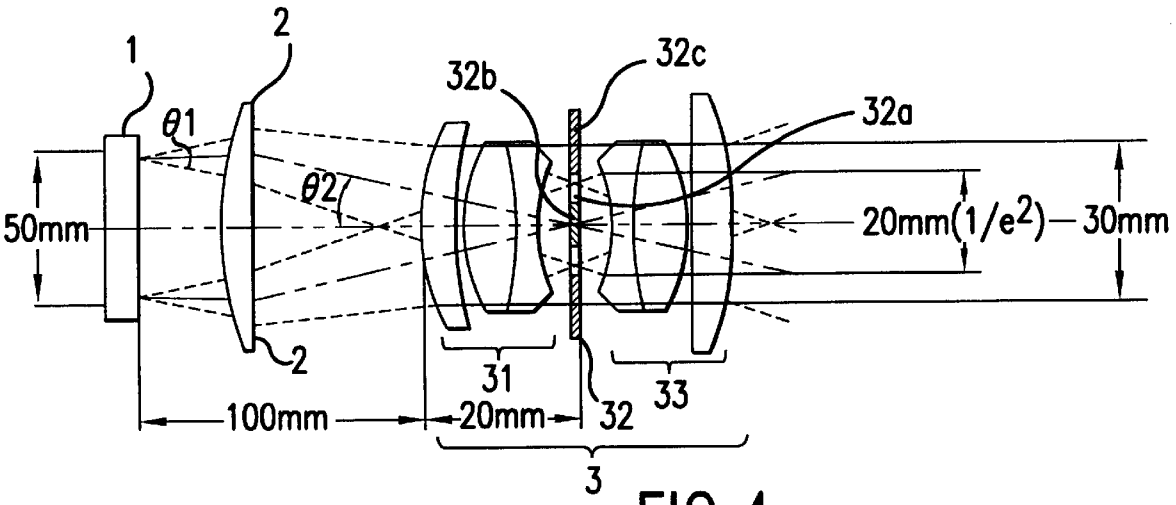
FIGS. 4*a–b* are explanatory views showing the operation and effects of a field lens in the first embodiment.
Figure 4B:
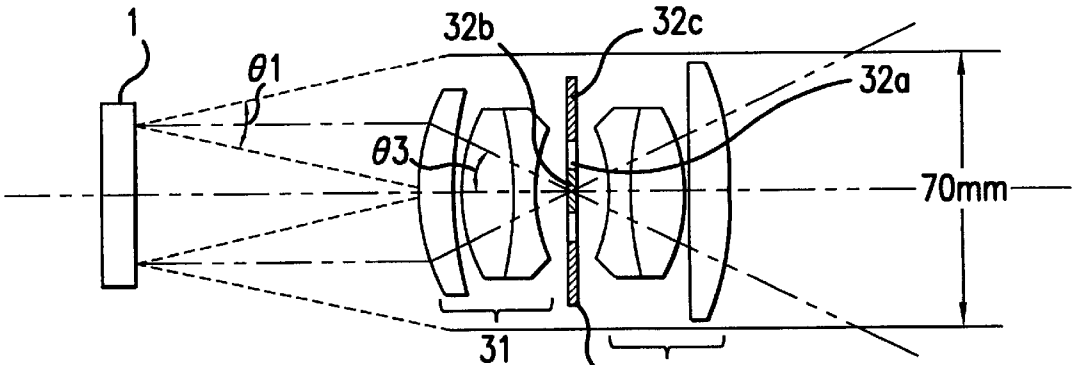

FIGS. 4(*a*) and 4(*b*) explain the operation and effects of the field lens 2 in the first embodiment of the image recording apparatus provided with an array-like light source according to the present invention explained in connection with FIGS. 1 to 3. FIG. 4(*a*) has a field lens 2, and FIG. 4(*b*) has no field lens 2.

The spacing of the semiconductor laser positioned on both ends in the main scanning direction of the semiconductor laser array 1 is 50 mm. Accordingly, the semiconductor laser in the semiconductor laser array 1 positioned farthest from the optical axis of the image forming lenses 31 and 32 is at a position 25 mm from the optical axis.

In FIGS. 4(*a*) and 4(*b*), the distance from the beam emission surface of the semiconductor laser array 1 to the incident surface of the front group lens 31 is 100 mm, and the distance from the incident surface of the front group lens 31 to the annular aperture 32 is 20 mm.

In FIG. 4(*a*), the laser beam of the semiconductor laser farthest from the optical axis of the image forming lenses 31, 33 in the semiconductor laser array 1 diffuses at a diffusion angle of $\theta 1=11.4$ degrees. The advancing direction of the laser beam after being emitted is parallel with the optical axis of the lens 31, 33, but the laser beam is bent by the field lens 2 and is incident on the pupil position of the image forming lenses 31, 33 at an angle of $\theta 2=14$ degrees with respect to the optical axis. The laser beam diffused outside from the semiconductor laser on both ends of the semiconductor laser array 1 has the width of 30 mm and is incident on the incident surface of the front group lens 31 and transmits through the transmitting portion 32*a* of the annular aperture 32. The outside diameter of the transmitting portion 32*a* is 20 mm, which corresponds to the outside diameter of the luminous flux of the laser beam having a $1/e^2$ light intensity.

In FIG. 4(*b*), the laser beam emitted from the semiconductor laser farthest from the optical axis of the image forming lenses 31, 33 in the semiconductor laser array 1 diffuses at a diffusion angle of $\theta 1=11.4$ degrees. Since the field lens is not provided, the laser beam parallel with the optical axis is bent at the incident surface of the front group lens 31 and is incident on the pupil position of the image forming lenses 31, 33 at an angle of $\theta 3=51$ degrees. The laser beam diffused outside from the semiconductor laser on both ends of the semiconductor laser array 1 diffuses in width that cannot be covered by the image forming lenses 31, 33 and has the width of 70 mm at the incident surface of the front group lens 31.

Accordingly, if the field lens 2 is not provided, the following inconveniences occur.

(1) Since the incident angle $\theta 3$ is large, 51 degrees, an eclipse caused by a lens-barrel of the image forming lenses 31, 33 is large. As a result, the quantity of light of the laser beam of the semiconductor laser away from the optical axis is smaller than the quantity of light of the laser beam of the semiconductor laser near the optical axis. This causes an uneven quantity of light, deteriorating the image.

(2) Since the difference between the incident angle $\theta 3=51$ degrees and $\theta 2=14$ degrees is large, a difference of influence of an eclipse caused by the pupil of the image forming lenses 31 and 33, whereby a difference in diffraction state occurs. This appears as a variation of a beam diameter on the photosensitive drum, deteriorating the image quality.

(3) The effective diameter of the image forming lenses 31, 33 increases from 30 mm to 70 mm. Since the image forming lenses 31, 33 are required to have a high accuracy, when the effective diameter is large, cost increases.

The aforementioned three inconveniences are notable as the length in the main scanning direction of the semiconductor laser array 1 increases.

Figure 5A:
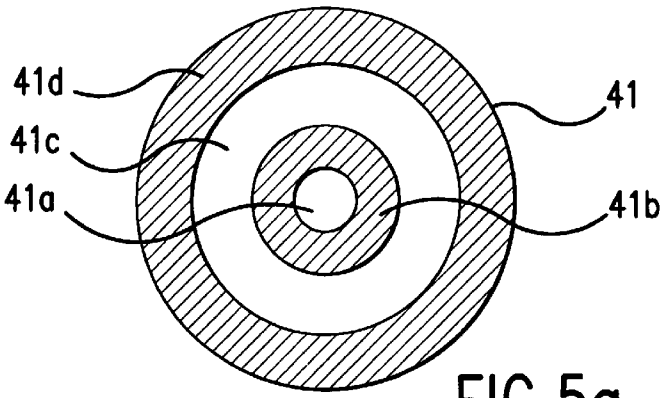
FIGS. 5*a–b* are explanatory views showing a second embodiment of an image recording apparatus provided with an array-like light source according to the present invention.
Figure 5B:
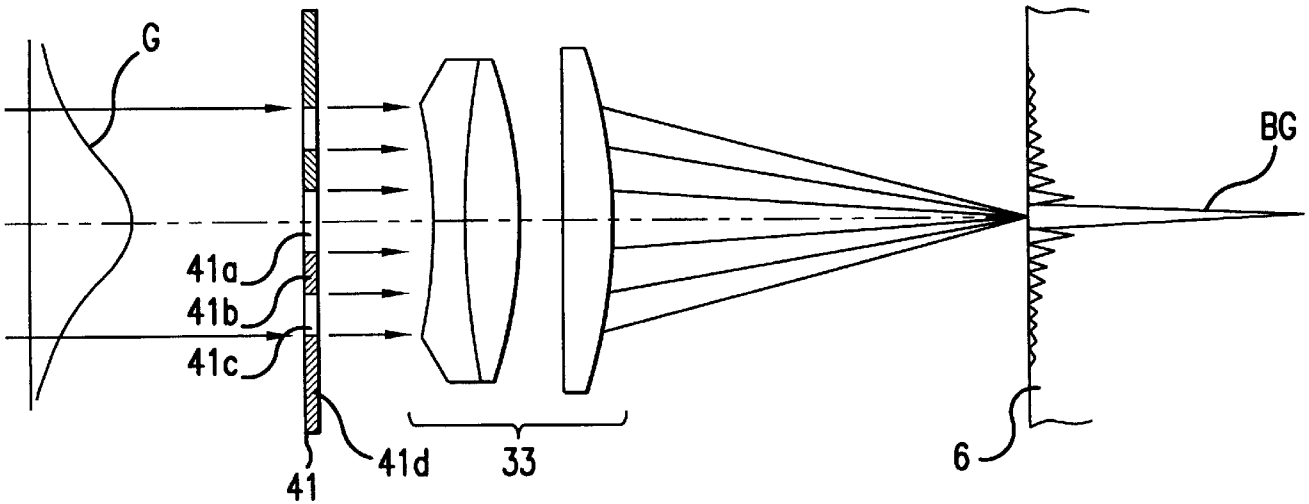

FIGS. 5(*a*) and 5(*b*) show a second embodiment of an image recording apparatus provided with an array-like light source according to the present invention. FIG. 5(*a*) shows a zonal shield plate 41 used in the second embodiment, and FIG. 5(*b*) shows that the shield plate 41 is arranged in a pupil position of the image-forming lenses 31, 33 (only the rear group lens 33 is shown). The image recording apparatus is as shown in FIGS. 1 to 3.

In the second embodiment, the zonal shield plate 41 comprises light transmitting portions 41*a*, 41*c* and shield plate portions 41*b*, 41*d*. The center of the zonal shield plate 41 is arranged to coincide with the optical axis of the image forming lenses 31, 33.

With the constitution described above, the laser beam emitted from the semiconductor laser array 1 is incident on the image forming lenses 31, 33 via the field lens 2, and is converted from the light intensity distribution G of the Gaussian type to the light intensity distribution BG of the Bessel-Gaussian type by the zonal shield plate 41.

Figure 6A:
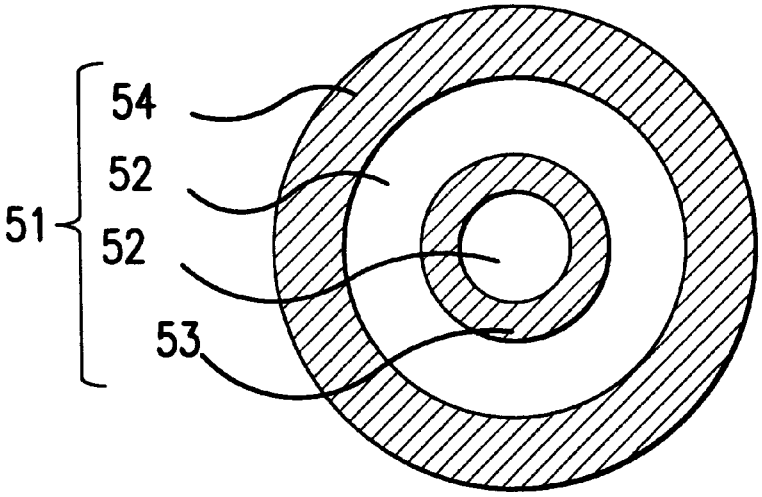
FIGS. 6*a–b* are explanatory views showing a third embodiment of an image recording apparatus provided with an array-like light source according to the present invention.
Figure 6B:
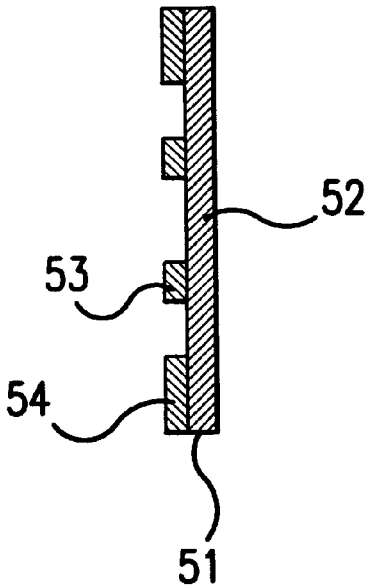

FIGS. 6(*a*) and 6(*b*) show a zonal phase plate 51 used in a third embodiment of an image recording apparatus provided with an array-like light source according to the present invention. The image recording apparatus is as shown in FIGS. 1 to 3. The zonal phase plate 51 has a ring-like ½ wavelength phase plate 53 provided on an optical glass plate 52 and a ring-like shield plate 54. A light transmitting portion is formed within the center of the ½ wavelength phase plate 53 and between, the ½ wavelength phase plate 53 and the shield plate 54.

In the third embodiment, the phase plate 51 has the center coincident with the optical axis of the image forming lenses 31, 33, and arranged at their pupil position.

With the constitution described above, the laser beam emitted from the semiconductor laser array 1 is incident on the image forming lenses 31, 33 via the field lens 2, and is converted from the light intensity distribution of the Gaussian type to the light intensity distribution of the Bessel-Gaussian type by the zonal phase plate 51, and is formed at the photosensitive drum 6.

Figure 7A:
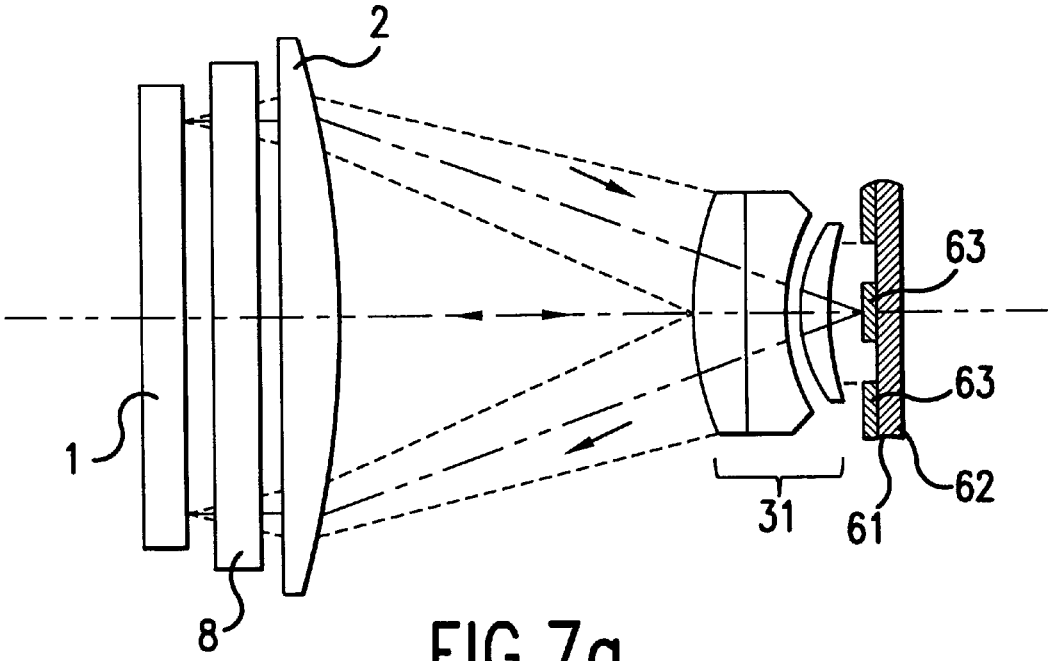
FIGS. 7*a–b* are emplanatory views showing a fourth embodiment of an image recording apparatus provided with an array-like light source according to the present invention.
Figure 7B:
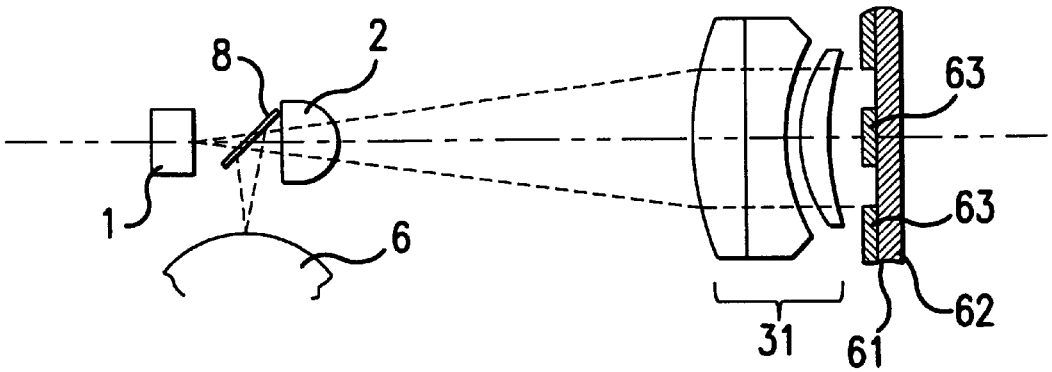

FIGS. 7(*a*) and 7(*b*) show a fourth embodiment of an image recording apparatus provided with an array-like light source according to the present invention. Parts common to those of the first to third embodiments are indicated by common reference numerals, and redundant explanation is omitted. The rear group lens 33 of the image forming lenses is omitted. A zonal mirror 61, which functions as a beam conversion element, is arranged in a pupil position of the front group lens 31 which also has a function of the rear group lens 33, and a half mirror 8 is provided between the semiconductor laser array 1 and the field lens 2. The zonal mirror 61 is constituted by providing a light absorbing layer 63 (a circular one and a ring-like one are concentrically arranged) on the surface of a mirror 62.

Figure 8A:
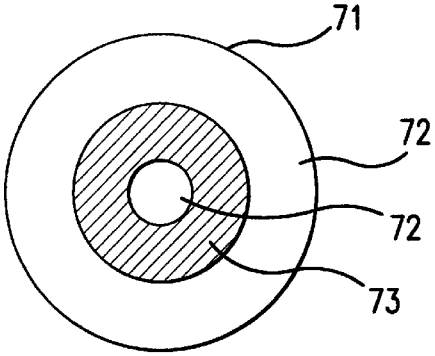
FIGS. 8*a–b* are explanatory views showing a fifth embodiment of an image recording apparatus provided with an array-like light source according to the present invention.
Figure 8B:
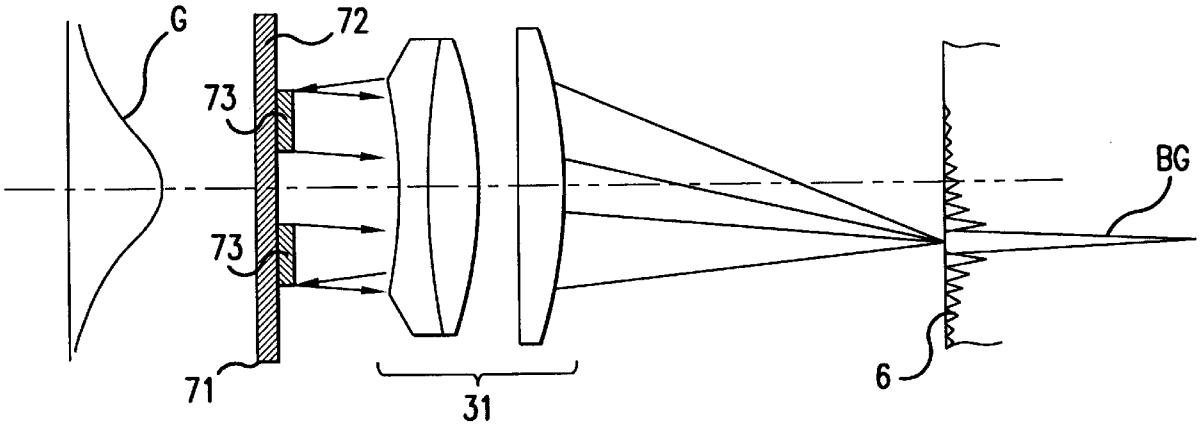

FIGS. 8(*a*) and 8(*b*) show a fifth embodiment of an image recording apparatus provided with an array-like light source according to the present invention. This embodiment is the same as the fourth embodiment except that the constitution of a zonal mirror 71 is different from the zonal mirror 61. The zonal mirror 71 has a ring-like mirror 73 provided on the surface of a light absorbing plate 72, and the center thereof coincides with the optical axis of the front group lens 31.

In the fourth and fifth embodiments, a plurality of laser beams emitted from the semiconductor laser array 1 are collected by the field lens 2 after having been transmitted through the half mirror 8. The collected beams are then collimated by the front group lens 31, reflected by the zonal mirror 61 or 71, thereafter again incident on the front group lens 31 from the opposite side, subjected to forming action by the front group lens 31, and are thereafter transmitted through the field lens 2 and reflected by the half mirror 8 to form an image on the photosensitive drum 6. The laser beam formed on the photosensitive drum 6 is converted in light intensity distribution from Gaussian type indicated by G to Bessel-Gaussian type indicated by BG, having a large focal depth.

The light beam conversion element is not limited to those shown in the first to fifth embodiments. For example, a truncated cone-shaped prism may be used to provide a ring-like laser beam with a hollow center.

While in the above-described embodiments, the image recording apparatus provided with an array-like light source has been described, it is to be noted that when the scanning surface is not arranged on the exposure surface of the photosensitive drum 6, the apparatus can be used as a scanner apparatus for reading images on the scanning surface or the like with high accuracy. When used as a scanner apparatus, it is not necessary to modulate the plurality of laser beams emitted from the semiconductor laser array with an image signal.

Figure 9:
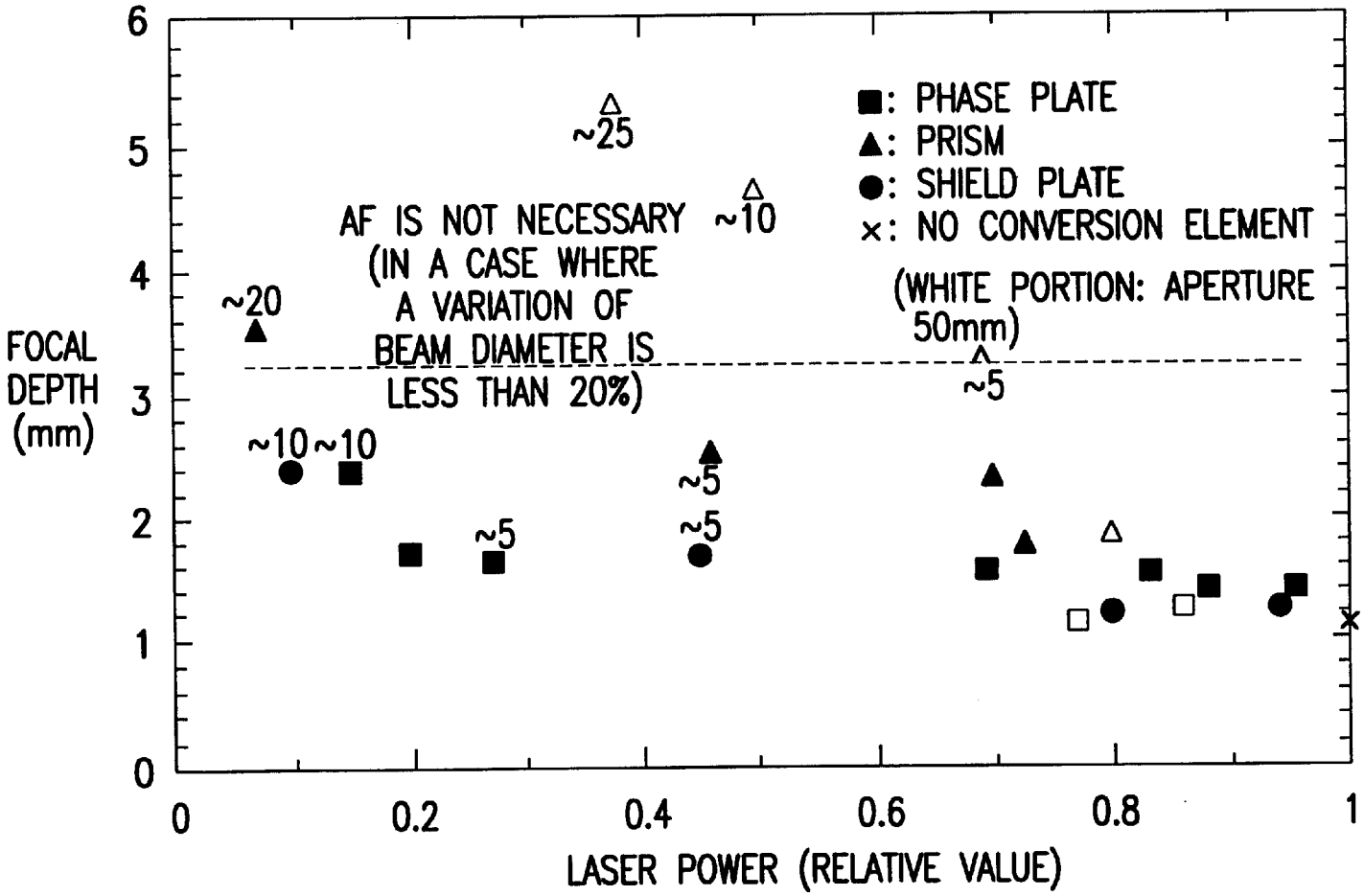
FIG. 9 is an explanatory view showing the focal depth of an optical system obtained by the image recording apparatus according to the present invention.

FIG. 9 shows the focal depth with respect to the laser power (relative value). The numerical values indicated on some plots represent the variation rate of a beam diameter. The focal depth is the length of beam waist corresponding to the region less than 20%. If the image forming surface of the photosensitive body is within the range of the beam waist, an autofocus mechanism (AF) is not necessary. The shown results are obtained under the conditions that the incident pupil diameter (effective diameter of the image forming lenses 31, 32) is 13.1 mm, the aperture (outside diameter of the light transmitting portion of the zonal shield plate 41, the zonal phase plate 51, the prism, etc.) is 12.9 mm (black mark) and 50 mm (white mark), and the diameter of laser beam is 26 $\mu$m. In the drawing, the dotted line in which the focal depth is drawn at a point of 3.3 mm (AF is not necessary) corresponds to the total amount 3.3 mm of axis-displacement of the image recording apparatus. That is, in the image recording apparatus, the variation caused by inclination is 2.0 mm, the variation caused by accuracy of the photosensitive drum 6 is 0.3 mm, the variation caused by heat is 0.4 mm, and the variation caused by curvature of the image surface is 0.5 mm, and the total amount of axis-displacement caused by these variations is 3.3 mm.

As described above, according to the scanner apparatus and the image recording apparatus provided with an array-like light source of the present invention, a plurality of laser beams are collected within a limited space region and then formed into a plurality of collimated beams, and the plurality of laser beams collimated are beam-converted so as to have the light intensity distribution of Bessel-Gaussian type. Therefore, even if there are a change in temperature, an unevenness of mounting accuracy, an unevenness of parts accuracy, vibrations or the like, the focal depth of the image forming beam is large, and therefore, a deviation in position of the focal point can be suppressed. Further, even if the length in the main scanning direction of the semiconductor laser array is long, it is possible to suppress the variation of the quantity of light of the image forming beams and the beam diameter.

What is claimed is:

1. A scanner apparatus comprising:

a light source array that emits a plurality of light beams;

a collector that collects said plurality of light beams emitted from said light source array and transmits the light beams to a limited space region from which the light beams are focused on a scanning surface;

a collimator located at said limited space region, said collimator collimating said light beams to form a plurality of collimated light beams; and a spatial filter that includes a first portion that absorbs or blocks light surrounded by a second portion that reflects or transmits light so that the spatial filter imparts modulation to a spatial spectrum of said collimated light beams formed by said collimator, said spatial filter located at a position where optical axes of the collimated light beams intersect each other.

2. A scanner apparatus according to claim 1, wherein said spatial filter is a light beam converter that converts a light intensity distribution of said light beams to a Bessel-Gaussian type distribution.

3. A scanner apparatus according to claim 2, wherein said light beam converter is arranged in a pupil position of said collimator.

4. A scanner apparatus according to claim 3, wherein said light beam converter is a zonal aperture.

5. A scanner apparatus according to claim 3, wherein said light beam converter is a zonal shield plate.

6. A scanner apparatus according to claim 3, wherein said light beam converter is a zonal phase plate.

7. A scanner apparatus according to claim 3, wherein said light beam converter is a zonal mirror.

8. An image recording apparatus comprising:

a light source array that emits a plurality of light beams modulated according to an image signal;

a collector that collects said plurality of light beams emitted from said light source array and transmits the light beams to a limited space region from which the light beams are focused on a photosensitive body to form an electrostatic latent image on said photosensitive body;

a collimator located at said limited space region, said collimator collimating said light beams to form a plurality of collimated light beams; and a spatial filter that includes a first portion that absorbs or blocks light surrounded by a second portion that reflects or transmits light so that the spatial filter imparts modulation to a spatial spectrum of said collimated light beams formed by said collimator, said spatial filter located at a position where optical axes of the collimated light beams intersect each other.

9. An image recording apparatus according to claim 8, wherein said spatial filter is a light beam converter that converts a light intensity distribution of said light beams to a Bessel-Gaussian type distribution.

10. An image recording apparatus according to claim 9, wherein said light beam converter is arranged in a pupil position of said collimator.

11. An image recording apparatus according to claim 10, wherein said light beam converter is a zonal aperture.

12. An image recording apparatus according to claim 10, wherein said light beam converter is a zonal shield plate.

13. An image recording apparatus according to claim 10, wherein said light beam converter is a zonal phase plate.

14. An image recording apparatus according to claim 10, wherein said light beam converter is a zonal mirror.

15. A scanner apparatus comprising:

a plurality of light sources that emit a plurality of light beams;

a collector that collects said plurality of light beams and transmits the plurality of light beams toward a scanning surface;

a collimator that receives and collimates the plurality of light beams transmitted by the collector to form a plurality of collimated light beams that are transmitted along intersecting optical axes toward the scanning surface; and a spatial filter that includes a first portion that absorbs or blocks light surrounded by a second portion that reflects or transmits light so that the spatial filter imparts modulation to a spatial spectrum of said plurality of light beams, said spatial filter located in a path of said collimated light beams output by the collimater.

16. A scanner apparatus according to claim 15, wherein said spatial filter is located at a position where the optical axes of the collimated light beams intersect each other.

17. A scanner apparatus according to claim 15, wherein said scanner apparatus is an image recording apparatus, the light beams emitted by said plural light sources are modulated according to an image signal, and said scanning surface is a photosensitive surface on which an electrostatic latent image is formed by said modulated light beams.

18. A scanner apparatus according to claim 15, wherein said spatial filter converts a light intensity distribution of said light beams to a Bessel-Gaussian type distribution.

19. A scanner apparatus according to claim 18, wherein said spatial filter includes at least one light absorbing portion located radially inside a light non-absorbing portion.

20. A scanner apparatus according to claim 19, wherein said light non-absorbing portion is light transmissive.

21. A scanner apparatus according to claim 19, wherein said light non-absorbing portion is light reflective.

* * * * *